US010335660B1

(12) United States Patent
Pizzirusso

(10) Patent No.: US 10,335,660 B1
(45) Date of Patent: Jul. 2, 2019

(54) BALL RETURN DEVICE

(71) Applicant: Rosario Pizzirusso, Merrick, NY (US)

(72) Inventor: Rosario Pizzirusso, Merrick, NY (US)

( * ) Notice: Subject to any disclaimer, the term of this patent is extended or adjusted under 35 U.S.C. 154(b) by 0 days.

(21) Appl. No.: 15/641,297

(22) Filed: Jul. 4, 2017

(51) Int. Cl.
*A63B 69/00* (2006.01)
*A63B 63/00* (2006.01)
*A63B 69/40* (2006.01)
*A63B 71/02* (2006.01)

(52) U.S. Cl.
CPC ..... *A63B 63/00* (2013.01); *A63B 69/0097* (2013.01); *A63B 69/40* (2013.01); *A63B 2063/001* (2013.01); *A63B 2071/025* (2013.01); *A63B 2225/09* (2013.01); *A63B 2243/007* (2013.01)

(58) Field of Classification Search
CPC ..... A63B 63/00; A63B 69/0097; A63B 69/40; A63B 2063/001; A63B 2071/025; A63B 2225/09; A63B 2243/007
USPC ..... 473/195–197, 476–479, 438, 439, 456, 473/447, 448; 273/407, 398–400; D21/662, 780, 788
See application file for complete search history.

(56) References Cited

U.S. PATENT DOCUMENTS 1,218,390 A * 3/1917 Gates ..... A63B 71/022 473/194
1,933,159 A * 10/1933 Butler ..... A63F 7/0612 473/478
2,247,852 A * 7/1941 Saunders ..... A63B 63/083 273/400
2,899,208 A * 8/1959 Wallsteiner ..... A63B 63/00 473/194
3,856,301 A * 12/1974 Davidson ..... A63B 63/00 473/197
3,895,809 A * 7/1975 Shockley ..... A63B 69/0097 473/194
3,929,334 A 12/1975 Magazzu
4,703,931 A * 11/1987 Steen ..... A63B 69/0097 473/435
4,815,736 A * 3/1989 Wright ..... A63B 71/022 473/421
4,949,979 A * 8/1990 Wheatcroft ..... A63B 63/00 473/197
5,018,731 A * 5/1991 Doyle ..... A63B 63/00 473/164
5,193,802 A 3/1993 Saltus
5,558,338 A 9/1996 Taub
5,609,528 A * 3/1997 Kehoe ..... A63B 69/3623 473/157
5,810,363 A 9/1998 Saunders et al.
D422,326 S 4/2000 Lai
6,543,776 B2 * 4/2003 Macaluso ..... A63B 71/022 473/454

(Continued)

*Primary Examiner* — Mitra Aryanpour
(74) *Attorney, Agent, or Firm* — The Law Office of Daniel T. Weglarz, P.C.

(57) ABSTRACT

A ball return device having a frame and an elastic reflector supported on the frame. The elastic reflector has a first open end that is connected to a rim, and an opposite second end that is downwardly tapered from the first end to form a vertex at the second end. The elastic reflector is connected at the second end to the frame by a tension cord that supplies tension to the elastic reflector. The degree of tension in the tension cord, as well as the location of the attachment point of the tension cord on the frame, are adjustable.

25 Claims, 4 Drawing Sheets

(56) References Cited

U.S. PATENT DOCUMENTS

| | | | | |
|---|---|---|---|---|
| 6,659,466 | B2 * | 12/2003 | Searles | A63B 63/00 273/400 |
| 6,881,154 | B2 * | 4/2005 | Neskudla | A63B 71/022 473/432 |
| 7,021,630 | B1 * | 4/2006 | Cho | A63B 63/00 473/454 |
| 7,401,785 | B1 * | 7/2008 | Waite | A63B 63/00 473/476 |
| 7,850,551 | B2 * | 12/2010 | Barber | A63B 63/00 473/439 |
| 8,308,166 | B2 * | 11/2012 | Cho | A63B 63/00 473/454 |
| D679,346 | S * | 4/2013 | Gustavsson | D21/662 |
| 8,900,076 | B1 * | 12/2014 | Shropshire | A63B 69/002 473/439 |
| 2005/0192126 | A1 * | 9/2005 | Remaklus | A63B 63/08 473/447 |
| 2007/0281807 | A1 * | 12/2007 | Cho | A63B 63/004 473/478 |
| 2010/0081513 | A1 * | 4/2010 | La Pointe | A63B 63/00 473/197 |
| 2015/0352420 | A1 * | 12/2015 | Sharp, Jr. | A63B 69/002 473/439 |

* cited by examiner

BALL RETURN DEVICE

BACKGROUND OF THE INVENTION

Field of the Invention

This invention relates generally to a sports training device and, more particularly, to an apparatus for catching and returning a ball delivered to it.

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

It is a common practice of players of various sports to train by throwing, kicking, or otherwise delivering a ball at a target in repetition to hone their skills and develop accuracy. For example, soccer, football, and baseball players commonly practice throwing or kicking a ball into a net or at a target, and baseball, lacrosse, and hockey players practicing their batting or shooting skills commonly practice hitting or shooting a ball or puck at a target or into a net. To facilitate recovery of the ball when a partner is not available, players commonly practice by delivering the ball at the surface of a wall so that it will rebound back towards the player's vicinity.

Furthermore, various devices are well known in the prior art for aiding in returning a ball to user when a wall in not available. Such devices typically include a net held within a frame to provide a flat, springy surface. When a ball is delivered at the net, it hits a planar surface that is perpendicular to the trajectory of the ball. This enables the ball to rebound off the net's surface and return in the general direction of the user.

Such known devices have significant shortcomings. For instance, they do not always return the ball to the user as accurately as desired, requiring the user to spend unnecessary time and energy chasing the ball, thus detracting from the efficiency of the user's training.

Moreover, such known devices are rather limited in their application. They typically are designed for use in training in only one or few sports. They are also often limited in the return trajectory of a ball that they can provide.

There thus exists a need for a ball return device capable of returning a ball to a user accurately, and capable of various applications to allow for variety in training.

SUMMARY OF THE INVENTION

The present invention is a ball return device providing greater variety and adjustability of return trajectory of the ball over existing ball return devices. The ball return device of the present invention includes a rim, an elastic reflector having a first open end and an opposite second end, wherein the first end is connected to the rim, and the elastic reflector is downwardly tapered from its first end to form a vertex at its second end. The rim and the vertex are connected to a frame. Preferably, a tension cord is used to connect the vertex to the frame, which pulls the vertex of the reflector away from the rim and provides tension to the reflector.

The device may be adjustable as to the location where the tension cord connects to the device, and adjustable as to the degree of tension in the tension cord. The rim is preferably pivotally connected to the frame so that the rim can be rotated to adjust the direction in which the opening of the reflector faces and to adjust the shape of the reflector. The height of the frame is adjustable to raise and lower the height of the rim. The rim may define a variety of shapes, including a circle, rectangle, octagon, or other polygon.

It is an object of the present invention to provide a ball return device having a wide range of adjustability. The present invention accomplishes that by providing adjustability of the height of the rim, the angle of the rim, the angle of the reflector, the depth of the reflector, and the degree of tension in the reflector.

These and other objects will be apparent to one of skill in the art.

DETAILED DESCRIPTION OF THE INVENTION

Figure 1:
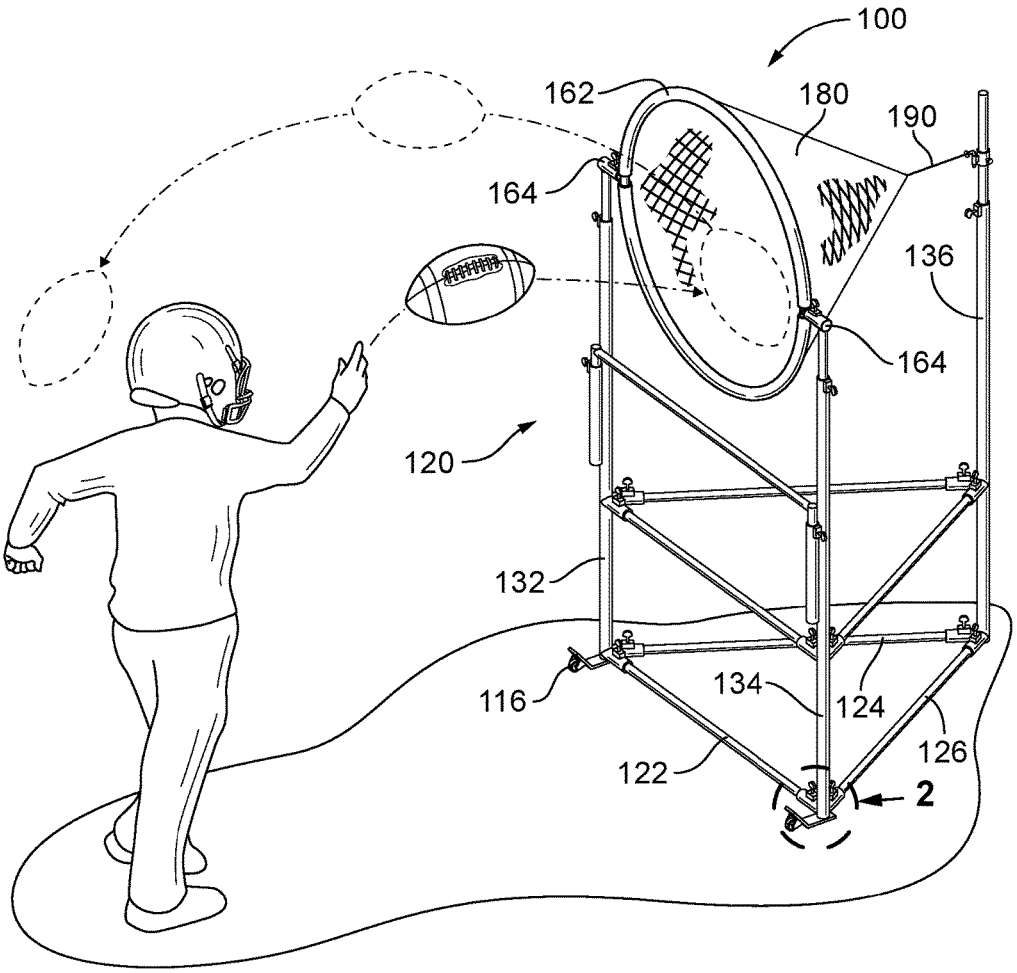
FIG. 1 is a front perspective view of a ball return device in accordance with the present invention shown with a user throwing a ball at the device, and illustrating the ball return aspect of the invention.

Referring now to the drawings, and in particular FIG. 1, a ball return device 100 is shown as a frame 120, and a reflector assembly 160.

For the sake of brevity, this disclosure refers generally to a "ball," but it is understood that the invention is equally capable of use with a puck or other piece of sports equipment that is thrown, kicked, or otherwise delivered through the air by a sports player.

The ensuing description provides preferred exemplary embodiments only, and is not intended to limit the scope, applicability, or configuration of the disclosure. Rather, the ensuing description of the preferred exemplary embodiments will provide those skilled in the art with an enabling description for implementing preferred and exemplary embodiments of the disclosure. It is apparent to a person of ordinary skill in the art, however, that the present invention may be practiced through many embodiments other that those illustrated. It should be understood that various changes may be made in the function and arrangement of elements without departing from the spirit and scope of the invention as set forth in the appended claims.

For the purposes of this disclosure, certain directional terms that may be used herein are used to facilitate the description of the invention. Unless otherwise specified or made apparent by the context of the discussion, such terms and the like should be interpreted with reference to the figure(s) under discussion. Such terms are not intended as a limitation on the position in which the invention or components may be used. It is contemplated that the components of the invention may be easily positioned in any desired orientation for use. Likewise, numerical terms, such as "first" and "second" are not intended as a limitation or to imply a sequence, unless otherwise specified or made apparent by the context of the discussion.

A number of terms may be clarified to facilitate understanding of the invention. The term "operatively connected" is understood to include a linking together of the portions under consideration and may include a physical engagement and/or a functional or operational connection.

Figure 4:
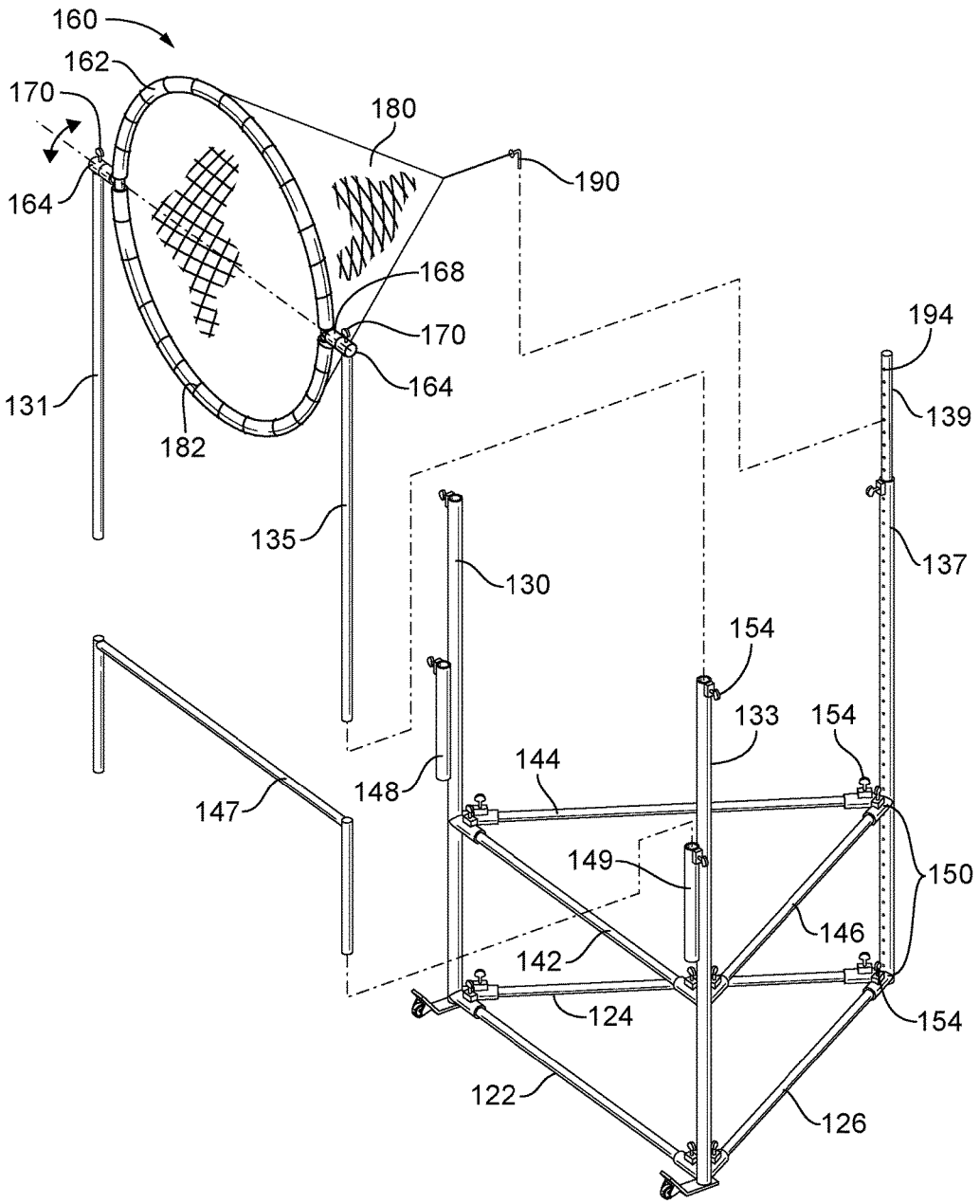
FIG. 4 is an exploded front perspective view of a ball return device in accordance with the present invention.

Referring now to the drawings and in particular FIGS. 1 and 4, there is illustrated a ball return device 100 comprising a reflector assembly 160 having a rim 162 and an elastic reflector 180, and a frame 120 that operates to maintain the reflector assembly 160 in a desired position and orientation.

The frame 120 comprises three base members, 122, 124, and 126, respectively, that are oriented horizontally and connected to each other at their ends to provide a triangular footprint as shown in FIG. 1.

Figure 8:
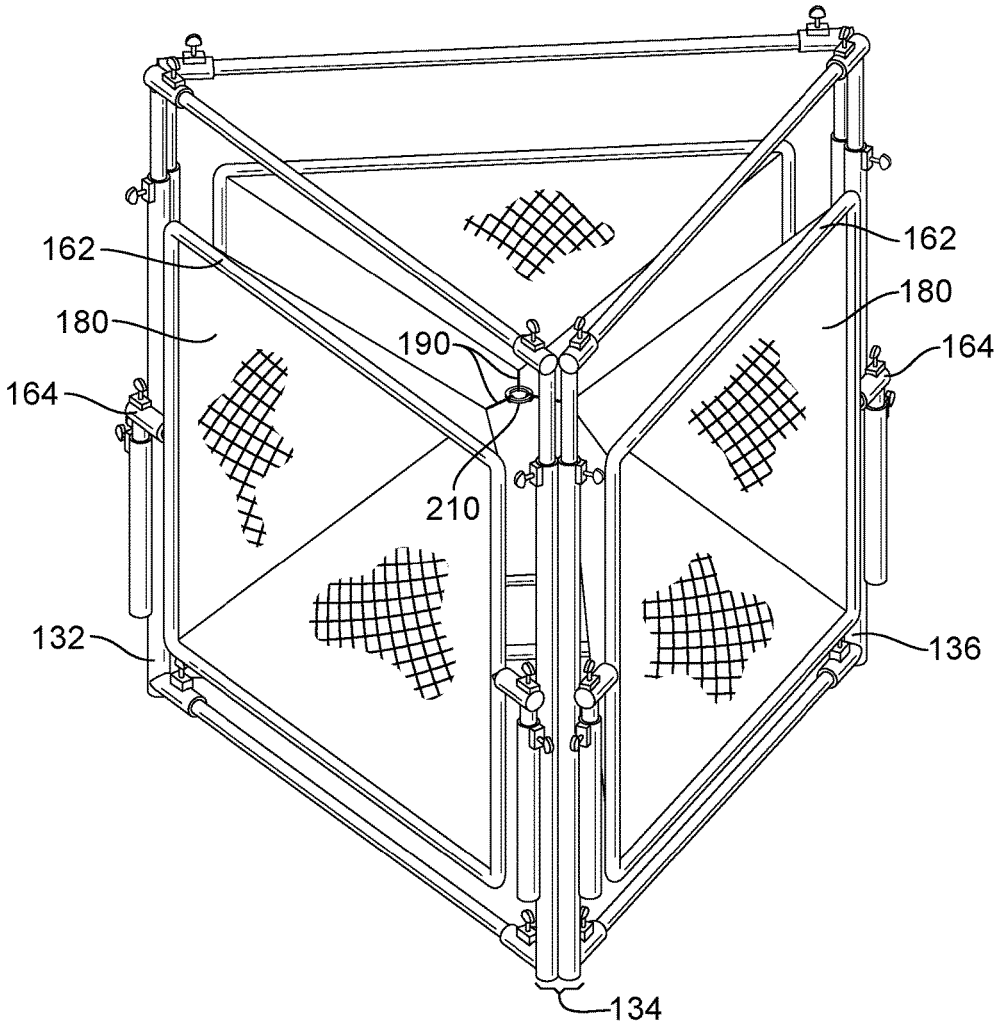
FIG. 8 is a front perspective view of a ball return device in accordance with the present invention shown having three elastic reflectors, each pulled towards a centrally-located point.

Such a design comprising a triangular footprint offers several practical benefits. For instance, such a design provides effective support to withstand the force exerted on the device 100 by a ball without the device 100 tipping over, while providing a space-efficient design. Such a design also allows for a three-sided ball return device 100, as shown in FIG. 8, that is capable of withstanding the force exerted by a ball directed at the device 100 from three different sides, as described below.

The frame 120 further comprises three legs 132, 134, and 136, respectively, that are connected in a vertical orientation to the base members at the corners of the triangle formed by the base members as shown in FIGS. 1 and 4. For example, the bottom end of leg 132 is connected with the ends of base members 122 and 124; the bottom end of leg 134 is connected with the ends of base members 122 and 126; and the bottom end of leg 136 is connected with the ends of base members 124 and 126.

In this manner, the frame 120 comprises a triangular base having three corners, a first leg 132 connected at a first end of the first leg 132 to a first corner of the triangular base and connected at a second end of the leg to the rim 162; and a second leg 134 connected at a first end of the second leg 134 to a second corner of the triangular base and connected at a second end of the leg to the rim 162.

The frame 120 preferably further comprises at least three cross braces 142, 144, and 146, respectively, that are connected at their ends to adjacent legs to add rigidity and strength to the frame 120 as shown in FIG. 4. In the preferred embodiment, cross brace 142 is removably connected at one end to leg 132 and at its other end to leg 134; cross brace 144 is removably connected at one end to leg 132 and at its other end to leg 136; and cross brace 146 is removably connected at one end to leg 134 and at its other end to leg 136, as shown in FIG. 4. In the preferred embodiment, the cross braces 142, 144, and 146 are oriented horizontally. In alternate embodiments, at least one of cross braces 142, 144, and 146, or at least one additional cross brace, may be oriented diagonally, i.e., coupling at different heights along the two adjacent legs that it connects to.

The base members 122, 124, and 126, the legs 132, 134, and 136, and the at least three cross braces 142, 144, and 146 are constructed of a rigid material forming elongated members so as to provide a sturdy, stable frame to support the reflector assembly 160. In a preferred embodiment, such members are constructed of strong, lightweight pipes, such as aluminum or PVC. In the preferred embodiment, such pipes exhibit a circular cross section, but in alternate embodiments, pipes exhibiting square or other shaped cross section may be utilized. Additionally, while these members are formed of hollow pipes in the preferred embodiment, in alternate embodiments they may be formed of solid rods.

Figure 7A:
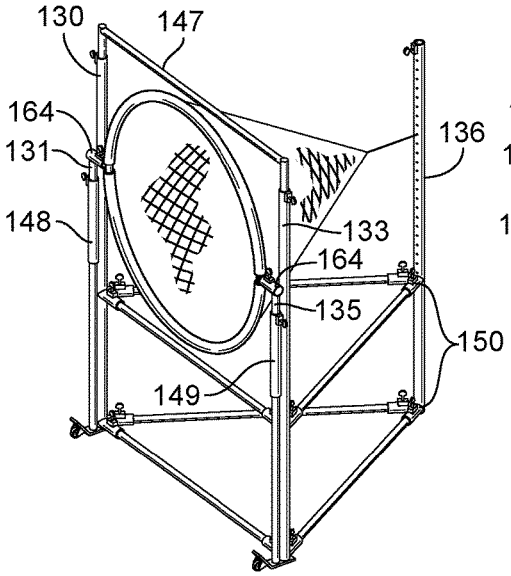
FIG. 7A is a front perspective view of a ball return device in accordance with the present invention shown with a frame adjusted to a low position and a tension cord pulling an elastic reflector straight back horizontally.
Figure 7B:
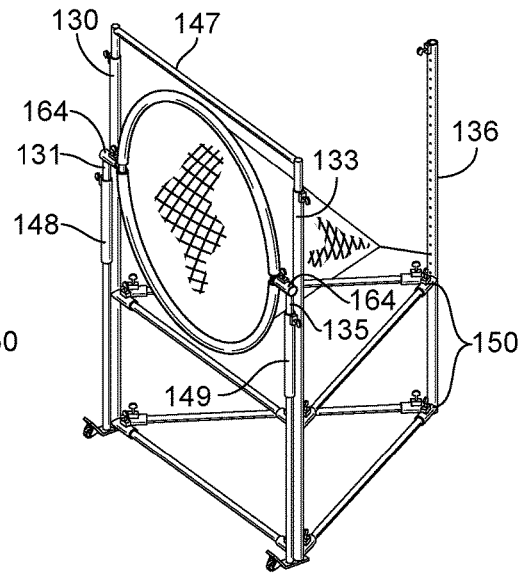
FIG. 7B is a front perspective view of a ball return device in accordance with the present invention shown with a frame adjusted to a low position and a tension cord pulling an elastic reflector back at a downward angle.

Any of the base members, legs, and cross braces may be connected to each other in the above-described configuration by any means known in the art. In the preferred embodiment, the members are removably connected together to allow for easy assembly and disassembly of the ball return device 100. In the preferred embodiment, this is accomplished by employing a three-way elbow or other removable coupling 150 known in the art for removably coupling pipes or other elongated members at their ends as shown in FIGS. 4, 7A, and 7B. The members may also be joined together permanently, such as by welding or by use of an adhesive.

In one embodiment, such members are removably connected via removable couplings 150 as described above, and a fastener 154 is employed to more securely maintain the respective members in a connected configuration as illustrated in FIGS. 4, 7A, and 7B. In such an embodiment, any removable coupling 150 may comprise at least one hole or passage (not shown) formed through its wall for receiving such fastener 154, and any member 122, 124, 126, 132, 134, 136, 142, 144, or 146 may comprise at least one hole or passage (not shown) formed through its wall for receiving such fastener 154. For example, a hole or passage formed through the wall of a removable coupling 150 may be positioned to align concentrically with a hole or passage formed through the wall of a base member near its end, such that the two holes or passages may receive a fastener 154 to prevent the unwanted decoupling of such base member. A hole or passage may likewise be included in the wall near any or all of the ends of any member so as to correspond with a hole or passage in the wall of its corresponding removable coupling 150.

A person of ordinary skill in the art would recognize various fasteners suitable for use as the fasteners 154. In the preferred embodiment, fasteners 154 comprise hand-manipulated fasteners of a type known in the art so as to enable the frame 120 to be assembled and disassembled without the aid of tools. Examples of fasteners 154 include a lock pin, a hitch pin, a linch pin, a clevis pin, a tension pin, a cotter pin, a cotterless hitch pin, a threaded fastener such as a screw or bolt and nut, and a pin biased outwardly by springs to engage the holes or passages in either the subject member or the coupling 150.

In the preferred embodiment, the frame 120 is adjustable in height. To accomplish this, at least one of legs 132, 134, and 136 are preferably constructed so as to be adjustable in length, such as by having a plurality of segments, wherein the segments are slidably connected. To this end, in the preferred embodiment, legs 132, 134, and 136 each comprise a plurality of concentric, telescoping segments that are slidably connected as illustrated in FIGS. 4 and 7A. For instance, leg 132 may comprise a first segment 130, and a second segment 131 slidably connected with and arranged concentrically within the first segment 130 so as to extend from and retract into the first segment 130. Likewise, leg 134 may comprise a first segment 133, and a second segment 135 slidably connected with and arranged concentrically within the first segment 133 so as to extend from and retract into the first segment 133. Likewise, leg 136 may comprise a first segment 137, and a second segment 139 slidably connected with and arranged concentrically within the first segment 137 so as to extend from and retract into the first segment 137.

In the preferred embodiment, each leg 132, 134, and 136 comprises a fastener 154 to maintain its first segment connected to its second segment while the device is in use. For instance, leg 132 may employ a fastener 154 to maintain its first segment 130 connected to its second segment 131 while the device is in use.

For purposes of leg 136 receiving a fastener 154, the first segment 137 may comprise at least one hole or passage formed through at least one of its walls that aligns concentrically with at least one hole or passage formed through at least one of the walls of the second segment 139 so as to receive fastener 154 as shown in FIG. 4. Likewise, legs 132 and 134 may comprise similarly situated holes or passages (not shown) for receiving their own respective fasteners 154 if they are desired for the height adjustment aspect.

This design provides for an adjustable length of the legs 132, 134, and 136 by enabling their second segments to telescope concentrically within their first segments, respectively, to extend from and retract into their respective first segments as desired. When it is desired to adjust the length of an leg 132, 134, or 136, the respective fastener 154 is disengaged or removed, the respective second segment is either extended from or retracted into the respective first segment until a different combination of hole or passage in the first segment and hole or passage in the respective second segment is concentrically aligned, and the respective fastener 154 is re-engaged or replaced, thereby locking the respective first and second segments together to maintain the adjusted length of the respective leg. When it is desired to disassemble the device 100 for storage or transport, the fasteners 154 may be disengaged or removed, and the first and second segments of each leg may be fully collapsed to a minimal length or completely disconnected. One of ordinary skill in the art would recognize various known fasteners suitable for fastening the telescoping segments of legs 132, 134, and 136 to restrain their telescoping movement.

Figure 2:
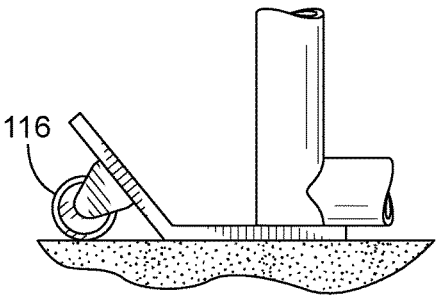
FIG. 2 is a side elevation view of a wheel of a ball return device in accordance with the present invention.
Figure 3:
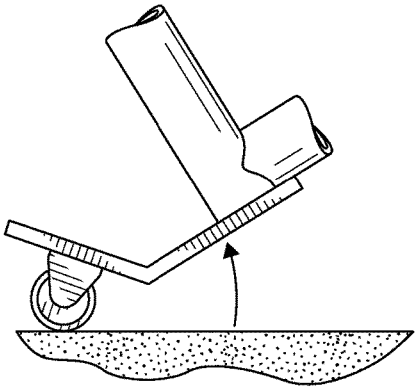
FIG. 3 is a side elevation view of a wheel of a ball return device in accordance with the present invention.

In the preferred embodiment, the device 100 comprises two casters or wheels 116, with one being disposed under or alongside each of two different legs such that the casters or wheels 116 do not contact the ground while the device 100 is free-standing in it's upright position as shown in FIG. 1, but can be put into contact with the ground by partially tilting the device 100 into an angled orientation. When a user holds the device 100 in the tilted orientation, the device is supported on the two casters or wheels 116 to enable the user to move or maneuver the device. The configuration of the preferred embodiment of the wheels 116 is shown in FIGS. 2 and 3. While the wheels 116 may be connected to the frame 120 at or near any two points on or near the base members 122, 124, and 126, they are preferably located under legs 132 and 134 as shown in FIG. 1.

In an alternate embodiment, the wheels 116 may be casters that depend from the bottom of the frame 120, with there preferably being one such caster at each corner of the triangle formed by base members 122, 124, and 126. In such an embodiment, the casters preferably include a swivelable yoke that is attached to and depends from the underside of the frame 120 near each corner of the triangle formed by base members 122, 124, and 126, with a caster wheel rotatably attached to each swivelable yoke. To this end, a swivelabe yoke may be fixed to the underside of each of the three couplings that are employed to connect base members 122, 124, and 126 to each other. In the described embodiment, all casters extend downwardly from the frame 120 and contact the ground to allow the device 100 to be easily moved along the ground.

The swivelability or pivotability of the yokes allows the device 100 to be steered as it is moved and maneuvered to a desired position. The downwardly extending legs of the yokes are angled or curved from the vertical to cause each caster wheel to turn in the direction the device is pushed or pulled. One or more of the casters may include selectively controllable brake mechanisms, as are known in the art of small caster wheels. This design allows the device 100 to be maneuvered easily, and also to be secured in a stationary position so that it does not roll when a ball contacts it. Since small casters such as those described above are well known in the art, the intricacies of their workings are not shown in the drawings.

One of ordinary skill in the relevant art would also recognize that stakes may be employed for securing the frame 120 to the ground during outdoor use. Such stakes may be "U-shaped" in order to fit over horizontal base members 122, 124, and 126 and push into the ground, thus securing the frame 120 to the ground. In another embodiment, a stake defining a single spike depends from the frame 120 at one or more of the vertices of the triangle formed by the base members 122, 124, and 126. In this embodiment, such stakes may comprise a length of an leg 132, 134, or 136 that extends below base members 122, 124, and 126, and such bottom end of the respective leg may be pointed.

The reflector assembly 160 comprises a rim 162, a reflector 180, at least one reflector attachment 182, and a tension cord 190.

As represented in FIGS. 1, 4, 7A, 7B, and 8, the reflector comprises a first open end and a second end, with the reflector downwardly tapered from the first end to form a vertex at the second end. For brevity, the term "reflector" is defined for purposes of this disclosure as any piece or assemblage of pieces of material so configured to have a first open end an opposite second end, and downwardly taper from the first end to form a vertex at the second end. The reflector 180 may be formed of any material configured to provide an elastic reflector, such as netting, elastic sheet material, a net formed of woven cord, or any other elastic material.

The reflector may be formed in a variety of shapes providing such tapered geometry. The shape of the reflector will be described below in terms of its axis. In this regard, the first end the reflector 180 defines an opening, and the reflector 180 has an axis passing through the vertex formed at the second end and passing through the centroid of its opening at the first end. The first end (that is, the opening) of the reflector 180 may form a circular opening with the reflector forming a conical geometry as shown in FIGS. 1, 4, 7A, and 7B. Importantly, the reflector 180 may be formed to comprise a first end exhibiting an opening of any polygonal shape, such as a circle, an ellipse, a rectangle, a hexagon, and an octagon. For example, the embodiment in FIG. 8 is shown with the reflector 180 having a first end that defines a rectangle, thus providing a reflector 180 having the shape of a pyramid. As another example, the reflector 180 may have a first end that defines an ellipse, thus providing a reflector having the shape of an elliptical cone.

Moreover, the shape of the reflector 180 is not limited by the shape of its opening defined by its first end. Numerous varieties of reflector shapes are possible for a reflector 180 having a given opening shape. This is due to the elastic nature of the reflector and the adjustable configuration of the tension cord 190 as will be described in more detail below. For instance, a reflector 180 having a circular opening may take the form of a right circular cone as shown in FIG. 7A, in which the axis of the reflector 180 passes through the center of the reflector's 180 opening at right angles to the plane of the opening. Since the opening of the reflector 180 is defined by the shape of the rim 162 onto which it is attached, the axis of the reflector 180 in this case would also be perpendicular to the rim 162. Alternatively, the reflector 180 may take the shape of an oblique circular cone by lowering the attachment point of the tension cord 190 on leg 136 as shown in FIG. 7B. In this case, the axis of the reflector 180 would not be perpendicular to the rim 162. It is noted that FIGS. 7A and 7B illustrate examples of two possible variations of a circular cone geometry, but numerous other variations are likewise possible by raising or lowering the attachment point of the tension cord 190 on leg 136 to varying degrees to create various angles between the axis of the reflector 180 and the rim 162. As described above in relation to reflectors 180 with circular openings having the potential to form right circular cones or oblique circular cones, reflectors having any other shape opening may likewise be right or oblique. In other words, a reflector 180 of any shape opening may have its axis passing through the plane of its opening at a right angle or at various other angles. For example, a reflector 180 having a rectangle opening may take the shape of a right pyramid or an oblique pyramid. In cases where the opening of the reflector 180 defines an irregular polygon and, thus, no clearly defined center point, the position of the vertex of the reflector 180 may similarly be altered relative to the position of the first end of the reflector.

The rim 162 comprises at least one rigid member forming a frame that supports the first end of the reflector 180 to maintain the shape of the opening of the reflector 180. It is appreciated that the rim 162 may be of various shapes, including regular and irregular polygons, and open and closed figures. For example, an open figure, such as a "U-shape" may be desirable because it may facilitate attaching the reflector 180 to the rim 162. Preferably, the rim 162 forms a closed figure, such as a circle or square. FIG. 4 illustrates a cone-shaped reflector 180 attached to a circular rim 162. FIG. 8 illustrates a pyramid-shaped reflector 180 attached to a rectangle rim 162. The at least one rigid member utilized to form the rim 162 preferably comprises pipe made of a lightweight and rigid material, such as aluminum or PVC pipe. Such elongated members may be bent to provide the desired shape of rim 162.

For example, in the preferred embodiment, a circular rim 162 may be formed from a single elongated member, such as aluminum pipe, so bent to form a circle. A rim 162 so shaped allows for the conical reflector 180 to maintain the shape of a cone possessing a circular base, so as to provide a reflector 180 having the shape of a circular cone.

In one embodiment, the rim 162 comprises four elongated members, such as aluminum or PVC pipe, connected at their ends to form a square-shaped rim 162 as shown in FIG. 8. A rim 162 so shaped allows for the first end of the reflector 180 to maintain the shape of a square, so as to provide a pyramid-shaped reflector 180. In such an embodiment, it would be preferable to form the reflector 180 from four triangular pieces of material, joined along their sides to an adjacent piece, to form a pyramid-shaped reflector 180.

In other embodiments, the rim 162 may form other shapes, including any regular or irregular polygon, or any open or closed figure.

The at least one reflector attachment 182 operates to secure the reflector 180 to the rim 162 along the edge of the reflector's opening. In one embodiment, the reflector attachment 182 comprises a hole or passage formed by the material of the reflector 180 that operates to receive the rim 162 for purposes of securing the reflector 180 to the rim 162. In an embodiment in which the material of the reflector 180 is netting, the existing holes of the netting may sufficiently serve as reflector attachments 182. In an alternate embodiment, the reflector 180 may comprise at least one channel formed by the material along the edge of the reflector's opening. In the preferred embodiment, the rim attachment comprises a hook that is securely fixed to the material of the reflector 180 near the edge of its opening and that removably fastens to the rim 162. In the preferred embodiment, the reflector 180 comprises a plurality of such hooks along the edge of the reflector's opening so as to maintain the edge of the reflector's 180 opening in close proximity to the rim 162. FIG. 4 depicts the a series of reflector attachments 182 in the form of hooks or loops of material connected to the reflector 180 and that loop around the rim 162.

The rim 162 may further comprise two rim attachments 164 that operate to connect the rim 162 to legs 132 and 134, as shown in FIG. 4. In a preferred embodiment, the rim attachments 164 pivotally connect the rim 162 to legs 132 and 134 so as to enable rotation of the rim relative to the frame. To this end, in the preferred embodiment, the rim attachment 164 comprises an elongated member 168, such as a pin, rod, screw, or bolt, extending from the rim 162 in a radially outward direction. A second such elongated member 168 is likewise disposed on the approximately opposite side of the rim 162, as shown in FIG. 4. Each elongated member 168 is pivotally connected with each of leg 132 and 134. This may be accomplished by a hole or passage formed in each of the leg's 132 and 134. In a preferred embodiment, such hole or passage is provided by a 90-degree elbow that is connected to one end to the respective leg 132 or 134 and configured to receive the corresponding elongated member 168, as shown in FIG. 4.

During use of the ball return device 100, the rim 162 will commonly be oriented in a vertical plane, thus orienting the opening of the reflector 180 facing a user positioned in front of the device 100. However, by varying the angle of the rim 162, the angle of a ball's return trajectory may be altered to provide variety in training, as will be described in more detail below. It is also contemplated that the rim 162 may be oriented horizontally during certain uses, such as practicing target practice with a flying disc and landing such flying disc within the rim 162.

In one embodiment, at least one rim attachment 164 may comprise a selectively engageable rim lock 170 that operates to prevent the rim 162 from pivoting, thus maintaining a desired angle at which the opening of the rim 162 is oriented. Such rim lock 170 is any fastener configured to selectively restrain rotation of the rim relative to the frame, and may comprise any type of fastener known in the art.

In one embodiment, a hole or passage (not shown) may be formed through the elongated member 168, as well as its corresponding leg of the frame or the 90-degree elbow connected to such leg's end, if present, for receiving the rim lock 170. For example, a hole or passage formed through the elongated member 168 may be positioned to align concentrically with a hole or passage formed through the wall its corresponding leg or the 90-degree elbow connected to its end, if present, and the rim lock 170 may be inserted through the holes or passages to prevent the unwanted pivoting or rotation of the rim 162. FIG. 4 depicts one embodiment of the rim lock 170 in the form of pin.

A person of ordinary skill in the art would recognize various fasteners suitable for use as the rim lock 170. In the preferred embodiment, rim lock 170 comprises a hand-manipulated fastener of a type known in the art so as to enable use of the position-locking feature of the rim 162 without the aid of tools. Examples of rim lock 170 include a lock pin, a hitch pin, a linch pin, a clevis pin, a tension pin, a cotter pin, a cotterless hitch pin, a threaded fastener such as a screw or bolt and nut, and a pin biased outwardly by springs to engage holes or passages in the elongated member 168 and the leg or 90-degree elbow.

The tension cord 190 comprises a piece of flexible cord configured to connect the vertex of the reflector 180 to the frame 120, and it preferably comprises a flexible, elastic cord. In the preferred embodiment, when the invention is in use, the tension cord 190 is connected at a first point on the tension cord 190 to the vertex of the reflector 180, and is connected at a second point on the tension cord 190 to the frame 120, so as to maintain the tension cord and the reflector 180 under tension, and thus, maintain the reflector 180 in its tapered shape. Preferably, the location at which the tension cord 190 connects to the frame 120 is at a location along the leg 136. The tension cord 190 provides sufficient tension on the reflector 180 so as to resist unwanted detaching of the reflector attachments 182 from the rim 162 during use of the invention, while enabling the reflector attachments 182 to be removed from the rim 162 for disassembly by a user.

This design satisfies a long-felt need in the art by providing a ball return device 100 comprising a tapered reflector 180 that is maintained under tension by a tension cord 190 during use, thus resulting in a device capable of returning a ball to a user with enhanced accuracy and, when desired, variety over existing devices known in the art. For example, a ball delivered into the vertex of the reflector 180 will exhibit a return trajectory having greater accuracy than that capable when using other known devices.

Further, such a design allows for enhanced variety of skill training of a user by providing for variety of return trajectory. For example, a ball delivered into the lower portion of the reflector 180, i.e., the area beneath the vertex, will tend to possess a return trajectory directed at an angle above the horizon, mimicking a "pop up" or "fly ball" as illustrated in FIG. 1. On the other hand, a ball delivered into the upper portion of the reflector 180, i.e., the area above the vertex, will tend to possess a return trajectory directed at an angle below the horizon, mimicking a "ground ball" or "grounder." Moreover, a ball delivered to the left portion of the reflector 180, i.e., the area left of the vertex, will tend to possess a return trajectory directed to the right of the user, and vice versa.

In one embodiment, the tension cord 190 is operatively connected at a first end to the reflector 180 at its vertex. A second point along the tension cord 190 is operatively connected to leg 136, as shown n FIG. 1. The tension cord 190 may be operatively connected to the reflector 180 and the frame 120 by any suitable method. For this purpose, the device 100 includes at least one attachment point 194, which is a point on the device configured to receive connection with the tension cord 190. In the preferred embodiment, the frame 120 comprises a plurality of attachment points along leg 136 so as to provide various locations at which to connect the tension cord. Changing the attachment point on the frame 120 at which the tension cord 190 connects is used to adjust the angle or shape of the reflector 180, and is useful in adjusting the height of the frame 120.

To facilitate the coupling of the tension cord 190 between the reflector 180 and the frame 120, the device 100 may comprise at least one tension cord fastener 196 configured to connect the tension cord 190 at a desired point along the tension cord to the frame 120. The tension cord fastener 196 may be any suitable fastener known in the art for connecting a cord to an anchor point. In this embodiment, the tension cord 190 is connected at a desired point along the tension cord 190 to the frame 120, such that changing the point along the tension cord 190 at which the tension cord is connected to the frame 120 varies the degree of tension in the tension cord 190 and varies the distance between the first end of the reflector 180 and the second end of the reflector 180.

Additionally or alternatively, the device 100 may comprise at least one tension cord fastener 196 configured to connect the tension cord 190 at a desired point along the tension cord to the vertex of the reflector 180. In this embodiment, the tension cord 190 is connected at a desired point along the tension cord 190 to the vertex of the reflector 180, such that changing the point along the tension cord 190 at which the tension cord is connected to the vertex of the reflector 180 varies the degree of tension in the tension cord 190 and varies the distance between the first end of the reflector 180 and the second end of the reflector 180.

In one embodiment of the tension cord fastener 196, the tension cord 190 is connected to leg 136 by tying it around leg 136 using any suitable knot, which would be considered the tension cord fastener 196 in this case. In an alternate embodiment, the tension cord fastener 196 comprises a loop on the tension cord 190. Such loop may be disposed near the second end of the tension cord 190 so as to connect the tension cord 190 to leg 136 by positioning the loop over the top end of leg 136 and sliding it down to a desired height. The tension cord 190 may comprise a plurality of tension cord fasteners 196, each in the form of a loop, at various points along the tension cord so as to provide various points along the tension cord 190 capable of connecting to the leg 136. Moreover, leg 136 may comprise at least one attachment point 194 in the form of a horizontal notch or groove formed into leg 136 for receiving the loop on the tension cord 190 to help prevent the loop from sliding up and down the leg 136. A plurality of such notches may be located at various points along the leg 136 to provide various attachment points 194 at which the tension cord 190 may connect to the frame 120. However, such notches may not be desired. In such case, the tension cord fastener 196 in the form of a loop can be free to slide up and down along leg 136, providing many possible attachment points 194 where the tension cord 190 may connect to the leg 136.

Figure 5:
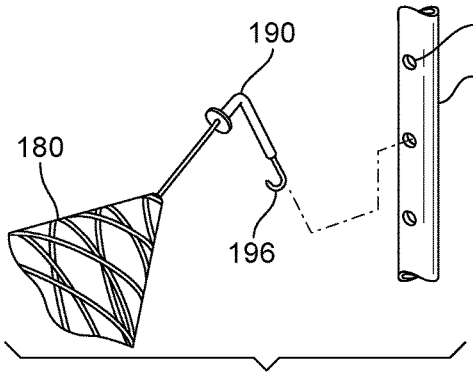
FIG. 5 is a front perspective view showing the manner in which an elastic reflector is connected to a frame of a ball return device in accordance with the present invention.

In an alternate embodiment, the attachment point 194 comprises a hole or passage formed through the leg 136, and preferably a plurality of such attachment points 194 are positioned along the length of leg 136 as shown in FIGS. 4 and 5. In this embodiment, the tension cord 190 has a tension cord fastener 196 that operates to engage one such hole or passage 194 so as to operatively connect the tension cord 190 to leg 136. The tension cord fastener 196 may comprise any suitable fastener known in the art. In one embodiment, the tension cord fastener 196 comprises a hook as shown in FIG. 5. The tension cord 190 may have a plurality of tension cord fasteners 196 disposed at various points along its length, each in the form of a hook, configured to engage the leg 136, so as to provide various points along the tension cord 190 capable of connecting to the leg 136. By providing a plurality of attachment points 194 in the form of holes in leg 136, as shown in FIGS. 4 and 5, the tension cord 190 may be connected to a desired point along the leg 136 by hooking one of the hooks through one of the holes. In this manner, the tension cord 190 is connected to the frame 120 by the tension cord fastener 196 at a desired point along the tension cord 190, such that changing the point along the tension cord 190 at which the tension cord is connected to the frame 120 varies the degree of tension in the tension cord 190 and varies the distance between the first end of the reflector 180 and the second end of the reflector 180.

Tension cord fasteners 196 may also be disposed at various points along the length of the tension cord 190 nearer to the first end of the tension cord 190 configured to connect the tension cord 190 at a desired point along the tension cord to the reflector 180, such that changing the point along the tension cord 190 at which the tension cord is connected to the vertex of the reflector 180 varies the degree of tension in the tension cord 190 and varies the distance between the first end of the reflector 180 and the second end of the reflector 180.

Figure 6:
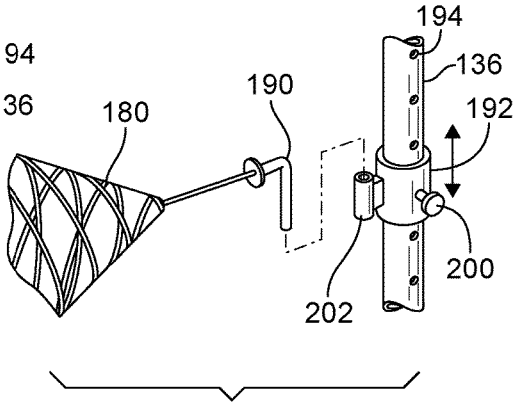
FIG. 6 is a front perspective view showing the manner in which an elastic reflector is slidably connected to a frame of a ball return device in accordance with the present invention, shown with a tension cord grip.

In the preferred embodiment, tension cord fastener 196 comprises a slidable collar 192 slidably mounted on the frame 120, and preferably on leg 136. The slidable collar 192 is any element configured to slide on the frame 120 and receive the tension cord 190, and may include a short section of pipe dimensioned and configured to slide on leg 136 as shown in FIG. 6. The collar 192 preferably includes a collar fastener 200 that operates to selectively fix the slidable collar 192 in a desired position on the frame, as shown in FIG. 6. A slidable collar 192 slidably mounted on leg 136 provides for an unlimited number of possible attachment points 194 along leg 136. Any point along leg 136 to which the collar 192 can slide can become an attachment point 194, and the collar 192 can be fixed in such desired position using the collar fastener 200.

A person of ordinary skill in the art would recognize various fasteners suitable for use as the collar fastener 200. In the preferred embodiment, collar fastener 200 comprises a hand-manipulated fastener of a type known in the art so as to enable adjustment of the position of the slidable collar 192 along leg 136 without the aid of tools. Examples of collar fastener 200 include a lock pin, a hitch pin, a linch pin, a clevis pin, a tension pin, a cotter pin, a cotterless hitch pin, a threaded fastener such as a screw or bolt and nut, and a pin biased outwardly by springs to engage an attachment point 194, which may comprise a hole formed through leg 136. In an alternate embodiment, the collar fastener 200 comprises a hand-manipulated threaded fastener configured to screw down onto the surface of leg 136 to connect the slidable collar 192 to leg 136 by means of friction between the end of collar fastener 200 and the outer surface of leg 136. A collar fastener 200 in the form of pin as shown in FIG. 6 may either be threaded to cooperate with attachment points 194 in the form of threaded holes, or may be non-threaded so as to slide into attachment points 194 in the form of non-threaded holes.

A single device 100 may also comprise more than one type of tension cord fastener 196. For example, disposed along the length of the tension cord 190 may be various loops, hooks, and even a slidable collar 192.

The tension cord fastener 196 may further comprise a tension cord grip 202, which is a cord-gripping device (or "cord grip") that operates to grip the tension cord 190 at a desired point along its length. Many such cord-gripping devices, or cord grips, are known in the art for gripping a cord, and any such known device may be used as the tension cord grip 202. The tension cord grip 202 is represented in FIG. 6 by a small section of pipe having an orifice configured to receive the tension cord 190. The orifice may include teeth or other gripping surface configured to restrain the tension cord 190 from slipping through the orifice. By pulling the tension cord 190 through the orifice in the tension cord grip 202 until reaching a desired degree of tension in the tension cord 190 and the reflector 180, and then activating the tension cord grip 202 to clamp down on or otherwise grip the tension cord 190, the desired degree of tension in the tension cord 190 and the reflector 180 may be maintained.

In the embodiment having the slidable collar 192, the tension cord grip 202 is preferably connected to or part of the slidable collar 192, as shown in FIG. 6. In embodiments not having the slidable collar 192, the tension cord grip 202 may be connected to or part of whatever form of tension cord fastener 196 is utilized. For example, in embodiments utilizing a tension cord fastener in the form of a hook, as in FIG. 5, the tension cord grip 202 may be connected to the hook such that the tension cord fastener (hook) 196 may hook to an attachment point 194 as described above and the tension cord 190 may pass through an orifice in the tension cord grip 202 or otherwise engage with the tension cord grip 202.

To adjust the degree of tension in the tension cord 190 and the reflector 180, the tension cord grip 202 is disengaged so as to enable it to slide along the tension cord 190. Once the tension grip 202 is positioned at a desired point along the tension cord 190, the tension cord grip 202 is engaged so as to prevent it from sliding along the tension cord 190. The tension cord 190 is connected to the frame 120 at a desired attachment point 194, such attachment point 194 preferably located on leg 136, either prior to or after the tension cord grip 202 is positioned at a desired point along the tension cord 190. As discussed, the tension cord 190 is connected to the attachment point 194 via the tension cord fastener 196, which may include a hook, loop, or slidable collar connected to the tension cord 190.

In embodiments not having a tension cord grip 202, it is still possible to adjust the tension in the tension cord 190 and reflector 180 by providing multiple tension cord fasteners 196. For example, multiple tension cord fasteners 196 in the form of loops or hooks may be disposed at various points along the length of the tension cord 190 as described above. Connecting the tension cord 190 to an attachment point 194 using one of the tension cord fasteners 196 near the second end of the tension cord tends to provide less tension in the tension cord 190 and reflector 180, whereas connecting the tension cord 190 to an attachment point 194 using one of the tension cord fasteners 196 closer to the first end of the tension cord 196 (the end that is connected to the vertex of the reflector 180) tends to provide greater tension in the tension cord 190 and reflector 180.

Increasing the degree of tension in the tension cord 190 tends to pull the vertex of the reflector 180 closer to the attachment point 194. In other words, increasing the degree of tension in the tension cord 190 tends to pull the vertex of the reflector 180 further away from the rim 162 and the first end of the reflector 180 by stretching the reflector, thus increasing the degree of tension in the reflector 180 and increasing the depth of the reflector 180. It is noted that variations in the degree of tension in the tension cord 190, and thus the reflector 180, results in variations in the return trajectory and the distance that the device 100 returns a ball, and these are also affected by the type of ball used with the device 100. For instance, when using a round ball, such as a baseball or a lacrosse, a greater degree of tension in the reflector 180 generally results in a faster return speed of the ball, whereas a lesser degree of tension in the reflector 180 generally results in a slower return speed of the ball. When using a football, however, it has been found that increasing the tension in the reflector 180 beyond a certain degree tends to result in an undesirable return speed and trajectory. This is likely due to the prolate spheroid shape of the ball. When using a football with the device 100, reducing the tension in the reflector 180 enough to offer a reasonable amount of springiness in the reflector 180 has been observed to provide a more desirable return trajectory of the football.

As described above, increasing the tension in the tension cord 190 and the reflector 180 by pulling the vertex of the reflector further away from the rim 162 increases the depth of the reflector 180. It is recognized that this changes the angles between the surface of the reflector and the reflector's axis. For instance, increasing the depth of the reflector 180 tends to decrease these angles, while reducing the depth of the reflector tends to increase these angles. A very shallow reflector 180 having very large angles between its surface and axis tends to offer a more direct return trajectory. That is, the magnitude of the angle at which the ball exits the reflector 180 opening will more closely match the magnitude of the angle at which the ball entered the reflector opening. In other words, it more closely approximates throwing a ball at wall or other flat surface. This results returning the ball a greater distance from the device 100, but the ball will not reach as great heights as it would with a deeper reflector 180.

A very deep reflector 180 having much smaller angles between its surface and axis tends to offer a return trajectory with more aggressive changes in direction. For example, when directing the ball into the reflector 180 below its vertex to produce a return trajectory angled up (mimicking a "pop up" or "fly ball"), the deeper reflector 180 shape will return the ball at a greater angle above the horizon, thus returning the ball a greater height into the air. Likewise, when directing the ball into the reflector 180 above its vertex to produce a return trajectory angled down (mimicking a "ground ball"), the deeper reflector 180 shape will return the ball at a greater angle below the horizon, thus returning the ball more directly towards the ground and not as far away from the device 100. Similarly, when directing the ball into the reflector 180 to the left of the vertex to produce a return trajectory directed to the right of the user, a deeper reflector 180 shape will result in a return trajectory more angled to the right of the user.

The shape of the reflector 180 may also be varied by varying the location at which the tension cord 190 connects to the frame 120. To enable such variations, the tension cord 190 is connected to the frame 120 by the tension cord fastener 196 at one of a plurality of attachment points 194 on the frame, such that changing the attachment point 194 at which the tension cord 190 is attached to the frame 120 varies the angle of the axis of the reflector 120 relative to the rim 162.

For example, in the preferred embodiment, while the rim 162 is maintained in a fixed orientation relative to the frame 120 using the rim lock 170, the shape of the reflector 180 may be varied as desired by repositioning the tension cord fastener 196 to various attachment points 194 along leg 136. For example, when the rim 162 is fixed in a vertical orientation, the tension cord fastener 196 may be fixed to a point along leg 136 level with the center of the rim 162 so as to conform the reflector 180 to the shape of a right cone with its axis oriented horizontally and perpendicular to the plane of the rim 162 as shown in FIG. 7A. Alternatively, by connecting the tension cord fastener 196 to a lower attachment point 194 along leg 136 (below the center of the rim 162), the elastic reflector 180 will stretch to conform to the shape of an oblique cone with its axis angled above the plane perpendicular to the plane of the rim 162 (i.e., above the horizontal plane in this example in which the rim 162 is oriented in the vertical plane) as shown in FIG. 7B. In like manner, connecting the tension cord fastener 196 to a higher attachment point 194 (higher than the center of the rim 162) will stretch the elastic reflector 180 into the shape of an oblique cone having its axis angled below the plane perpendicular to the plane of the rim 162 (i.e., below the horizontal plane in this example in which the rim 162 is oriented in the vertical plane). For simplicity, the above aspects of the present invention were described with reference to a circular rim 162, however such aspects are equally applicable with the use of any shape rim 162.

By varying the angle of the axis of the reflector 180 relative to the rim 162, the return trajectory of the ball can be altered. For example, when the rim 162 is oriented vertically, conforming the reflector 180 to have its axis angled above the horizontal plane as in the example shown in FIG. 7B, as compare to a reflector having a horizontal axis as in FIG. 7A, will cause balls thrown into the reflector below the vertex to exhibit a return trajectory more angled above the horizon, resulting in the ball reaching a greater height but traveling less distance. Balls thrown into such reflector 180 above the vertex will exhibit a return trajectory with a lesser angle below the horizon, resulting in a greater return distance.

To the contrary, when the rim 162 is oriented vertically, conforming the reflector 180 to have its axis angled below the horizontal plane, as compare to a reflector having a horizontal axis, will cause balls thrown into the reflector 180 below the vertex to exhibit a return trajectory angled less above the horizon, resulting in further return distance. Balls thrown into such reflector 180 above the vertex will exhibit a return trajectory with a greater angle below the horizon, resulting in less of a return distance.

It may further be desirable to vary the direction that the opening of the reflector 180 faces. This offers yet another way of varying the shape of the reflector 180, in addition to adjusting the tension cord 190. To make this possible, the rim 162 and the frame 120 are pivotally connected so as to enable rotation of the rim 162 relative to the frame 120 as shown in FIG. 4, such that rotation of the rim 162 relative to the frame 120 varies the angle of the axis of the reflector 180 relative to the rim 162. To hold the rim 162 in a desired orientation, the device 100 may use the selectively engageable rim lock 170 configured to selectively restrain rotation of the rim 162 relative to the frame 120.

The direction that the reflector 180 faces in embodiments having the rim lock 170 may be accomplished by disengaging or removing the rim lock 170, rotating the rim 162 into a desired plane, and then replacing or re-engaging the rim lock 170.

For example, by orienting the rim 162 vertically and connecting the tension cord 190 to an attachment point 194 on leg 136 that is level with the center of the rim 162, the reflector 180 will assume a shape having its axis perpendicular to the plane of the rim 162 (for example, a right circular cone or a right pyramid), as shown in FIG. 7A. Of course, this is provided the reflector 180 is formed to have its axis perpendicular to the plane of the reflector's opening when the reflector is in its non-stretched state (a reflector 180 fabricated having an oblique shape will not exhibit the same properties). The rim lock 170 may then be removed or disengaged to allow the rim 162 to rotate relative to the frame 120; the rim 162 may then be rotated into a desired plane, and the rim lock 170 may be replaced or re-engaged to restrain further rotation of the rim 162.

Such adjustments may be desirable because rotating the rim 162 out of a vertical orientation effectively reduces the size of the reflector's 180 opening from the perspective of a user standing in front of the device, as shown in FIG. 1. In other words, a user standing in front of the device 100 throwing a ball into the reflector 180 on a rim 162 that is not vertical would have to throw the ball with greater accuracy in order to get the ball into the opening.

Moreover, rotation of the rim 162 as described above can be used to vary the return trajectory of balls thrown into the reflector 180 by altering the angle of the axis of the reflector 180 with respect to the horizontal plane. For instance, when the rim 162 in the vertical plane and the tension cord is connected to the frame 120 at an attachment point 194 level with the center of the rim 162, the reflector 180 will assume a shape having its axis perpendicular to the plane of the rim 162 (for example, a right circular cone or a right pyramid), as shown in FIG. 7A. Of course, this is provided the reflector 180 is formed to have its axis perpendicular to the plane of the reflector's opening when the reflector is in its non-stretched state (a reflector 180 fabricated having an oblique shape will not exhibit the same properties).

Then, by rotating the rim 162 so as to point the opening of the reflector 180 below the horizon, the elastic reflector 180 will stretch in a manner that causes the vertex of the reflector 180 to rise higher than the center of the opening of the reflector 180. This new shape of the reflector will cause balls thrown into the reflector 180 below the vertex to exhibit a return trajectory angled less above the horizon, resulting in further return distance. Balls thrown into such reflector 180 above the vertex will exhibit a return trajectory with a greater angle below the horizon, resulting in less of a return distance.

To the contrary, by rotating the rim 162 so as to point the opening of the reflector 180 above the horizon, the elastic reflector 180 will stretch in a manner that causes the vertex of the reflector 180 to lower to a height below the center of the opening of the reflector 180. This new shape of the reflector will cause balls thrown into the reflector below the vertex to exhibit a return trajectory more angled above the horizon, resulting in the ball reaching a greater height but traveling less distance. Balls thrown into such reflector 180 above the vertex will exhibit a return trajectory with a lesser angle below the horizon, resulting in a greater return distance.

It may further be desirable to vary the direction that the opening of the reflector 180 faces while maintaining a particular shape of the reflector 180. To enable this, the rim 162 and the frame 120 are pivotally connected so as to enable rotation of the rim 162 relative to the frame 120 as shown in FIGS. 1 and 4; the frame includes a plurality of attachment points 194 configured to connect the tension cord 190 to the frame 120 at one of the attachment points 194, which are preferably located on leg 136, as shown in FIG. 5; and the tension cord 190 is connected to the frame 120 by the tension cord fastener 196 at one of the attachment points 194, such that changing the attachment point 194 at which the tension cord 190 is attached to the frame 120 varies the angle of the axis of the reflector 180 relative to a horizontal plane without changing the shape of the reflector 180. The shape of the reflector 180 is capable of remaining the same in this scenario because, as the tension cord 190 is moved to higher or lower attachment points 194 on the frame 120, the tension in the tension cord 190 and the reflector 180 pull the pivotable rim 162 into a plane having the same angle with the axis of the reflector 180 as before adjusting the attachment point 194. Since the reflector 180 is preferably formed so as to have an axis perpendicular to the plane of its opening (for example, a right circular cone or a right pyramid) when the reflector is in its non-stretched state, the angle between the plane of the rim 162 and the axis of the reflector 180 will preferably remain a right angle while the tension cord 190 is under tension and moved between various attachment points 194. However, since it is possible to form a reflector 180 having an axis not perpendicular to the plane of its opening (for example, an oblique circular cone or an oblique pyramid) when the reflector 180 is in an non-stretched state, the angle between the axis of the reflector 180 and the plane of the rim 162 may not be a right angle, but will nonetheless remain the same while the tension cord 190 is under tension and moved between various attachment points 194.

To vary the direction that the reflector 180 faces without changing the shape of the reflector 180 in embodiments having the rim lock 170, the orientation of the rim 162 would need to be manually adjusted. This may be accomplished by first disengaging or removing the rim lock 170, then changing the attachment point 194 at which the tension cord 190 connects to the frame 120, then rotating the rim 162 into a plane having the same angle with the axis of the reflector 180 as before adjusting the attachment point 194 or allowing the rim 162 to automatically rotate into such plane under the tension of the tension cord 190, and then replacing or re-engaging the rim lock 170.

For example, when using a circular rim 162, the reflector 180 may be conformed to the shape of a right circular cone by orienting the rim 162 vertically and selecting an attachment point 194 on leg 136 that is level with the center of the rim 162, as shown in FIG. 7A. The rim lock 170 may then be removed or disengaged to allow the rim 162 to rotate relative to the frame 120; then the tension cord fastener 196 may be repositioned to a lower attachment point 194 on leg 136 while maintaining the reflector 180 in the shape of a right circular cone by rotating the rim 162 such that it remains in a plane perpendicular to the tension cord 190. This now provides a reflector 180 conformed to a right circular cone but having its axis angled above a horizontal plane. Likewise, if the tension cord fastener 196 was repositioned to a higher attachment point 194 on leg 136, the reflector 180 would have its axis angled below a horizontal plane. The rim lock 170 may then be replaced or re-engaged to restrain further rotation of the rim 162. In this example, provided the reflector 180 is formed to have the shape of a right circular cone in a non-stretched state, disengaging or removing the rim lock 170 tends to enable the rim 162 to automatically rotate into a plane perpendicular to the axis of the reflector 180 under the tension of the tension cord 190 pulling the reflector 180. For simplicity, this adjustment was described using the example of a right cone, but any given shape of the reflector 180 may likewise be maintained while altering the angle of the rim 162, although the self-adjusting aspect of the rim 162 would not apply. For example, repositioning the tension cord fastener 196 to various attachment points 194 and maintaining the reflector 180 in the shape of an oblique cone (when using a reflector 180 formed to have the shape of a right circular cone in a non-stretched state) require manual rotation of the rim 162, as the rim 162 will not automatically rotate to the proper orientation in this scenario. It is not necessary for the above-described steps to be performed in the order described.

By varying the direction that the opening of the reflector 180 faces in this manner, the return trajectory of the ball can be altered. For example, pointing the opening of the reflector 180 below the horizon such that the vertex of the reflector is higher than the center of the opening will cause balls thrown into the reflector below the vertex to exhibit a return trajectory angled less above the horizon, resulting in further return distance. Balls thrown into such reflector 180 above the vertex will exhibit a return trajectory with a greater angle below the horizon, resulting in less of a return distance.

To the contrary, pointing the opening of the reflector 180 above the horizon such that the vertex of the reflector is lower than the center of the opening will cause balls thrown into the reflector below the vertex to exhibit a return trajectory more angled above the horizon, resulting in the ball reaching a greater height but traveling less distance. Balls thrown into such reflector 180 above the vertex will exhibit a return trajectory with a lesser angle below the horizon, resulting in a greater return distance.

As can be appreciated from the above descriptions, the variety of adjustments that the ball return device 100 of the present invention is capable of, individually or in combination, provide for tremendous variety in the function of the device 100 and a user's interaction with it. There is a long-felt need in the art for a ball return device capable of offering such a wide range of ball return trajectories and adjustability of return trajectories. The ball return device 100 of the present invention fills this need by providing adjustability of the angle of the rim 162, the degree of tension in the tension cord 190 and the reflector 180, and the location at which the tension cord 190 connects to the frame 120, which can be utilized individually or in combination to adjust the shape, angle, and tension of the reflector 180. The adjustments allow for adjustability and enhanced variation of the ball's return trajectory, beyond the already high level of variety of return trajectory provide by the tapered shape of the reflector 180. In addition, the frame 120 is adjustable in height so as to vary the height of the rim 162. Such variety is incredibly desirable in sports training and offers enormous benefit to the trainee.

Referring now to FIG. 8, there is shown an embodiment of the ball return device 100 comprising a plurality of reflector assemblies 160. Such a design provides a ball return device 100 capable for use with three users simultaneously. Preferably, the rims 162 of each of the three reflector assemblies 160 are oriented facing 120 degrees from each other, each one being disposed on a different side of an equilateral triangle formed by the frame 120 as shown in FIG. 8. The embodiment of FIG. 8 further has legs 132, 134, and 136 each including two adjacent sections of pipe to facilitate with assembly and disassembly of the device 100 and height adjustment of the device 100. Such configuration enables the height of each rim 162 to be adjusted individually, so as to enable a ball return device 100 having three reflectors 180, each at a different height. FIG. 8 illustrates an embodiment in which all three rims 162 are positioned low, near the ground, as is ideal when using the device 100 to return a kicked soccer ball.

It should also be noted that each of the three rims 162 may define a different shape, although FIG. 8 illustrates an embodiment with all three rims 162 having a rectangular shape. This embodiment is ideal for soccer training among three users having three soccer balls. Other embodiments may have the frame arranged to form a footprint other than an equilateral triangle, such as an isosceles or scalene triangle, so as to orient the three rims 162 (and openings of the three reflectors 180) angled in configurations other than 120 degrees apart relative to each other.

In the embodiment depicted in FIG. 8, the device 100 includes a link 210 configured to receive a tension cord 190. The link 210 is any structure suitable to provide an attachment point 194 for a tension cord 190 to connect to, and may include a ring as shown in FIG. 8. In the embodiment shown, the tension cords 190 of each of the three reflector assemblies 160 are connected at their first end to the vertex of their respective reflector 180, and connected at a second point along the tension cord 190 to an attachment point 194 disposed on the link 210, which is in the form of a ring. The use of the link 210 enables each of the three tension cords 190 to connect to such ring 210 using any suitable tension cord fastener (such as a knot or hook as described above), and each tension cord 190 may be maintained under tension exerted by the other two tension cords 190 similarly connected to the ring 210, thus also maintaining each of the three reflectors 180 under tension.

In an alternate embodiment, at least one of the tension cords 190 of the plurality of reflector assemblies 160 is connected at a second point along the tension cord 190 to an attachment point 194 on the leg that its respective rim 162 is not connected to. For instance, a reflector assembly 160 with its rim 162 operatively connected to legs 132 and 134 would have its tension cord 190 connected to leg 136 as shown in FIG. 1; whereas a reflector assembly 160 with its rim 162 operatively connected to legs 132 and 136 would have its tension cord 190 connected to leg 134; and a reflector assembly 160 with its rim 162 operatively connected to legs 134 and 136 would have its tension cord 190 connected to leg 132. This embodiment essentially has each tension cord 190 connected to the leg of the frame 120 that is behind the rim 162, as shown in FIG. 1.

It is to be understood that the invention is not limited in its application to the details of construction and to the arrangements of the elements set forth in the accompanying description or illustrated in the drawings. The invention is capable of other embodiments and of being practiced and carried out in various ways. Also, it is to be understood that the phraseology and terminology employed herein are for the purpose of description and should not be regarded as limiting. The disclosure may readily be utilized as a basis for the designing of other structures, methods, and systems for carrying out the present invention. It is important, therefore, that the claims be regarded as including equivalent constructions. The abstract and the disclosure are neither intended to define the invention, which is measured by the claims, nor are they intended to be limiting as to the scope of the invention in any way.

What is claimed is:

1. A device for returning a thrown ball, comprising:

a rim that is shaped and dimensioned to receive a ball;

an elastic reflector having a first open end and an opposite second end, wherein said first end is connected to said rim and defines an opening; wherein said elastic reflector is downwardly tapered from said first end to form a vertex at said second end; and wherein said reflector has an axis passing through the vertex of the reflector and the centroid of the opening of the reflector; and a frame; and wherein said rim and said vertex are connected to said frame;

a tension cord that connects the vertex of the reflector to the frame;

wherein the tension cord is connected at a first point on the tension cord to the vertex of the reflector and connected at a second point on the tension cord to the frame; and wherein the reflector and the tension cord are under tension;

a tension cord fastener configured to connect the tension cord at a desired point along the tension cord to at least one of the frame and the vertex of the reflector;

wherein the tension cord is configured such that changing the point along the tension cord at which the tension cord is connected to at least one of the frame and the vertex of the reflector varies the degree of tension in the tension cord and varies the distance between the first end of the reflector and the second end of the reflector; and wherein the tension cord fastener comprises a collar slidably mounted on the frame.

2. The device for returning a thrown ball of claim 1, wherein:

the rim defines a polygon.

3. The device for returning a thrown ball of claim 1, wherein:

the rim defines a circle.

4. The device for returning a thrown ball of claim 1, wherein:

the rim defines a rectangle.

5. The device for returning a thrown ball of claim 1, wherein:

the elastic reflector is formed from elastic netting.

6. The device for returning a thrown ball of claim 1, wherein:

the elastic reflector is formed from elastic sheet material.

7. The device for returning a thrown ball of claim 1, wherein:

the frame is adjustable in height.

8. The device for returning a thrown ball of claim 7, wherein:

the frame further comprises at least one leg;

said leg having a plurality of segments, wherein the segments are slidably connected.

9. The device for returning a thrown ball of claim 1, wherein:

the frame comprises:

a triangular base having three corners;

a first leg connected at a first end of the first leg to a first corner of the triangular base and connected at a second end of the first leg to the rim; and a second leg connected at a first end of the second leg to a second corner of the triangular base and connected at a second end of the second leg to the rim.

10. The device for returning a thrown ball of claim 1, wherein:

the rim and the frame are pivotally connected so as to enable rotation of the rim relative to the frame, such that rotation of the rim relative to the frame varies the angle of the axis of the reflector relative to the rim.

11. The device for returning a thrown ball of claim 10, further comprising:

at least one selectively engageable rim lock configured to selectively restrain rotation of the rim relative to the frame.

12. The device for returning a thrown ball of claim 1, wherein:

the frame includes a plurality of attachment points;

the tension cord fastener is configured to connect the tension cord to the frame at one of the plurality of attachment points;

the tension cord is connected to the frame by the tension cord fastener at one of the attachment points; and changing the attachment point at which the tension cord is attached to the frame varies the angle of the axis of the reflector relative to the rim.

13. The device for returning a thrown ball of claim 1, wherein:

the rim and frame are pivotally connected so as to enable rotation of the rim relative to the frame;

the frame includes a plurality of attachment points;

the tension cord fastener is configured to connect the tension cord to the frame at one of the plurality of attachment points;

the tension cord is connected to the frame by the tension cord fastener at one of the attachment points; and changing the attachment point at which the tension cord is attached to the frame varies the angle of the axis of the reflector relative to a horizontal plane without changing the shape of the reflector.

14. The device for returning a thrown ball of claim 1, wherein:

the tension cord fastener comprises a hook.

15. The device for returning a thrown ball of claim 1, wherein:

the tension cord fastener comprises a cord grip configured to selectively grip the tension cord at a desired point along the tension cord.

16. A device for returning a thrown ball, comprising:

a rim that is shaped and dimensioned to receive a ball;

an elastic reflector having a first open end and an opposite second end, wherein said first end is connected to said rim and defines an opening; wherein said elastic reflector is downwardly tapered from said first end to form a vertex at said second end; and wherein said reflector has an axis passing through the vertex of the reflector and the centroid of the opening of the reflector; and a frame; and wherein said rim and said vertex are connected to said frame;

said frame includes a plurality of attachment points;

a tension cord that connects the vertex of the reflector to the frame;

wherein the tension cord is connected at a first point on the tension cord to the vertex of the reflector and connected at a second point on the tension cord to the frame; and wherein the reflector and the tension cord are under tension;

a tension cord fastener configured to connect the tension cord to the frame at one of the plurality of attachment points; and wherein changing the attachment point at which the tension cord is attached to the frame varies the angle of the axis of the reflector relative to the rim.

17. The device for returning a thrown ball of claim 16, wherein:

the frame is adjustable in height.

18. The device for returning a thrown ball of claim 16, wherein:

the frame comprises:

a triangular base having three corners;

a first leg connected at a first end of the first leg to a first corner of the triangular base and connected at a second end of the first leg to the rim; and a second leg connected at a first end of the second leg to a second corner of the triangular base and connected at a second end of the second leg to the rim.

19. The device for returning a thrown ball of claim 16, wherein:

the rim and the frame are pivotally connected so as to enable rotation of the rim relative to the frame, such that rotation of the rim relative to the frame varies the angle of the axis of the reflector relative to the rim.

20. The device for returning a thrown ball of claim 19, further comprising:

at least one selectively engageable rim lock configured to selectively restrain rotation of the rim relative to the frame.

21. A device for returning a thrown ball, comprising:

a rim that is shaped and dimensioned to receive a ball;

an elastic reflector having a first open end and an opposite second end, wherein said first end is connected to said rim and defines an opening; wherein said elastic reflector is downwardly tapered from said first end to form a vertex at said second end; and wherein said reflector has an axis passing through the vertex of the reflector and the centroid of the opening of the reflector; and a frame; and wherein said rim and said vertex are connected to said frame; the frame includes a plurality of attachment points;

wherein the rim and frame are pivotally connected so as to enable rotation of the rim relative to the frame;

a tension cord that connects the vertex of the reflector to the frame;

wherein the tension cord is connected at a first point on the tension cord to the vertex of the reflector and connected at a second point on the tension cord to the frame; and wherein the reflector and the tension cord are under tension;

a tension cord fastener configured to connect the tension cord to the frame at one of the plurality of attachment points; and wherein changing the attachment point at which the tension cord is attached to the frame varies the angle of the axis of the reflector relative to a horizontal plane without changing the shape of the reflector.

22. The device for returning a thrown ball of claim 21, wherein:

the frame is adjustable in height.

23. The device for returning a thrown ball of claim 21, wherein:

the frame comprises:

a triangular base having three corners;

a first leg connected at a first end of the first leg to a first corner of the triangular base and connected at a second end of the first leg to the rim; and a second leg connected at a first end of the second leg to a second corner of the triangular base and connected at a second end of the second leg to the rim.

24. The device for returning a thrown ball of claim 21, wherein:

the rim and the frame are pivotally connected so as to enable rotation of the rim relative to the frame, such that rotation of the rim relative to the frame varies the angle of the axis of the reflector relative to the rim.

25. The device for returning a thrown ball of claim 24, further comprising:

at least one selectively engageable rim lock configured to selectively restrain rotation of the rim relative to the frame.

* * * * *